US008746329B2

(12) United States Patent
Blomgren et al.

(10) Patent No.: US 8,746,329 B2
(45) Date of Patent: Jun. 10, 2014

(54) HEAT EXCHANGER PLATE, A PAIR OF TWO HEAT EXCHANGER PLATES, AND PLATE PACKAGE FOR A PLATE HEAT EXCHANGER

(75) Inventors: Ralf Blomgren, Skanor (SE); Joakim Krantz, Helsingborg (SE)

(73) Assignee: Alfa Laval Corporate AB, Lund (SE)

( * ) Notice: Subject to any disclaimer, the term of this patent is extended or adjusted under 35 U.S.C. 154(b) by 1454 days.

(21) Appl. No.: 11/913,254

(22) PCT Filed: May 18, 2006

(86) PCT No.: PCT/SE2006/000575

§ 371 (c)(1),
(2), (4) Date: Oct. 31, 2007

(87) PCT Pub. No.: WO2007/004939

PCT Pub. Date: Jan. 11, 2007

(65) Prior Publication Data

US 2008/0210414 A1 Sep. 4, 2008

(30) Foreign Application Priority Data

Jul. 4, 2005 (SE) ..... 0501561

(51) Int. Cl.
*F28F 3/08* (2006.01)
*F28D 9/00* (2006.01)
*F28F 3/02* (2006.01)

(52) U.S. Cl.
CPC ..... *F28D 9/005* (2013.01); *F28F 3/025* (2013.01)
USPC ..... 165/167; 165/166

(58) Field of Classification Search
CPC ..... F28D 9/005; F28F 3/025
USPC ..... 165/166, 167
See application file for complete search history.

(56) References Cited

U.S. PATENT DOCUMENTS 4,376,460 A * 3/1983 Skoog ..... 165/167
4,434,643 A 3/1984 Almqvist et al.

(Continued)

FOREIGN PATENT DOCUMENTS

EP 0 463 298 1/1992
FR 2 692 666 12/1993

(Continued)

OTHER PUBLICATIONS

International Preliminary Report on Patentability.

(Continued)

*Primary Examiner* — Allen Flanigan
(74) *Attorney, Agent, or Firm* — Buchanan Ingersoll & Rooney PC

(57) ABSTRACT

The invention refers to a heat exchanger plate (11), a pair of heat exchanger plates, and a plate package for a plate heat exchanger. Each heat exchanger plate includes a heat transfer area (33) and a distribution area (34) which adjoins the heat transfer area along a borderline (35). The distribution area has projections and depressions abutting depressions and projections, respectively, on a distribution area of adjacent heat exchanger plates. The heat transfer area has projections (51) and depressions (52) abutting depressions and projections, respectively on a heat transfer area of adjacent heat exchanger plates for forming first contact surfaces positioned at a first distance from each other along a direction substantially parallel with the borderline. The heat transfer area includes a transition area (58), which adjoins the distribution area along the borderline and has projections and depressions abutting depressions and projections, respectively, of a heat transfer area of adjacent heat exchanger plates for forming second contact surfaces at a second distance from each other along the first direction. The second distance is significantly shorter than the first distance.

22 Claims, 5 Drawing Sheets

(56) References Cited

U.S. PATENT DOCUMENTS

| | | | | | |
|---|---|---|---|---|---|
| 4,781,248 | A | * | 11/1988 | Pfeiffer | 165/167 |
| 4,966,227 | A | * | 10/1990 | Andersson | 165/167 |
| 5,174,370 | A | * | 12/1992 | Hallgren | 165/166 |
| 5,509,471 | A | | 4/1996 | Hallgren | |
| 8,061,416 | B2 | * | 11/2011 | Geskes et al. | 165/167 |

FOREIGN PATENT DOCUMENTS

| | | | |
|---|---|---|---|
| GB | 1 339 542 | A | 12/1973 |
| JP | 58-96987 | A | 6/1983 |
| JP | 63-25494 | A | 2/1988 |
| JP | 6-241672 | A | 9/1994 |
| JP | 7-243781 | A | 9/1995 |
| JP | 2001-99583 | A | 4/2001 |
| WO | 85/02670 | A1 | 6/1985 |
| WO | WO99/49271 | | 9/1999 |
| WO | WO 9949271 | A2 * | 9/1999 |

OTHER PUBLICATIONS

English translation of Japanese Office Action issued on Jul. 14, 2011, by the Japanese Patent Office, in corresponding Japanese Patent Application No. 2008-520210 (2 pages).

European Search Report issued on Sep. 4, 2012, by the European Patent Office, in corresponding European Patent Application No. 06733414.4 (6 pages).

* cited by examiner

HEAT EXCHANGER PLATE, A PAIR OF TWO HEAT EXCHANGER PLATES, AND PLATE PACKAGE FOR A PLATE HEAT EXCHANGER

THE BACKGROUND OF THE INVENTION AND PRIOR ART

The present invention refers to a heat exchanger plate for a plate package for a plate heat exchanger. The invention also refers to a pair of heat exchanger plates comprising a first heat exchanger plate and a second heat exchanger plate. Furthermore, the invention refers to a plate package for a plate heat exchanger.

Such plate heat exchangers with heat exchanger plates of the initially defined kind comprise commonly a central heat transfer area with a so-called herringbone pattern, which means that the corrugations of a parallel ridges and valleys of adjacent plates abut each other in such a way that substantially point-shaped contact surfaces are formed between the plates, and with distribution areas at the portholes on the end areas of the heat exchanger plates. The distribution areas are commonly provided with so-called distribution patterns ("chocolate patterns"), i.e. the corrugations of adjacent plates are designed in such a way that they form substantially line shaped contact surfaces between adjacent plates. In the transition between the distribution area and the central heat transfer area, i.e. where the corrugation patterns change design, the strength becomes somewhat reduced than at the central heat transfer area proper and the distribution areas proper. The reason therefor is that the different construction methods of the corrugation patterns, which means that the herringbone pattern has many small closely positioned contact surfaces whereas the distribution pattern has large but few contact surfaces with a free structure therebetween.

FIG. 1 discloses schematically a heat exchanger plate 1 where, in an area at the top to the right, a pattern has been drawn in the transition between the central heat transfer area 2 and the distribution area 3. In FIG. 2 this area is shown in a larger scale. The rhomboids 4 correspond to the line-shaped contact surfaces at the bottom plane of the heat exchanger plate 1 and the rhomboids correspond to the line-shaped contact surfaces at the upper plane of the heat exchanger plate 1. The lines 6 are valleys of the heat exchanger plate 1 concerned whereas the lines 7 are the ridges of an adjacent heat exchanger plate 1. Where the valleys 6 cross the ridges 7 point-shaped contact surfaces are created, which absorbs pressure load. In FIG. 2, the herringbone pattern of the central heat transfer area 2 is a typical so called pattern with high NTU (Number of Heat Transfer Units) with an acute angle of approximately 65° between the ridges and a centre axis x in the longitudinal direction of the heat exchanger plate 1. FIG. 3 discloses a typical so called pattern with low NTU with a corresponding acute angle of approximately 25°. The pattern with high NTU gives a relatively high flow resistance whereas the pattern with low NTU gives a relatively low flow resistance.

The pattern with high NTU gives the distance A1 along the width between the contact surfaces, which is significantly larger than the corresponding distance A2 of the pattern with low NTU. In the transition to the distribution area, this is of great importance for the strength since the contact surfaces have to take a part of the load on the distribution area. If the distance A1 is compared with A2 it can be seen that A1 is twice as long as A2. Since the number of contact surfaces in the row is reciprocally proportional to the distance, the pattern with low NTU will give twice as many support points as the pattern with high NTU along the transition to the distribution area. The longer the distance along the width between the contact surfaces is, the larger the load on each contact surface will be, and it is difficult to avoid large free surfaces which are highly loaded. In addition to a higher load on the contact surfaces on the pattern with high NTU, a collapsing load for the fields in the distribution area also becomes lower.

The heat exchanger plate with pattern with high NTU on the central heat transfer area will thus determine the maximal pressure performance for the heat exchanger plates in the cases when this area is dimensioning. If the heat exchanger plates always are provided with a pattern with low NTU on the central heat transfer surface, the above mentioned strength problems will not occur. However, in many cases it is desirable to use a so-called pattern with high NTU on the central heat transfer area in order to obtain a high heat transfer.

U.S. Pat. No. 4,781,248 discloses a heat exchanger plate of the initially defined type. This heat exchanger plate is intended to be included in a plate package for a plate heat exchanger. It is especially referred to FIG. 4 in this document, which discloses a distribution area with a distribution pattern and a central heat transfer area with a pattern with high NTU.

SUMMARY OF THE INVENTION

The object of the present invention is to avoid the problem mentioned above at the transition between the distribution area and the central heat transfer area. More precisely, the object is to provide an improved strength at the transition between the distribution area and the central heat transfer area.

This object is achieved by the heat exchanger plate initially defined, which is characterized in that the central heat transfer area comprises at least a first transition area, which adjoins the first distribution area along the borderline and which has projections and depressions which are adapted to abut depressions and projections, respectively, of a central heat transfer area of adjacent heat exchanger plates in the plate package for forming second contact surfaces which are positioned at a second distance from each other along said direction which is substantially parallel with the borderline, wherein the second distance is significantly shorter than the first distance.

By such a transition area substantially more support points between adjacent plates are achieved in the proximity of the distribution area so that the plate package in a better way may resist the load which the plate package is subjected to during operation. The support points along a line in parallel with the borderline will be substantially more closely positioned and thus substantially more than according to the previously known technique, in particular when the central heat transfer area has a so called pattern with high NTU.

According to an embodiment of the invention, the central heat transfer area has a corrugation, which forms said projections and depressions and which extends along a direction forming an acute first angle with the centre axis, wherein the first transition area has a corrugation, which forms said projections and depressions and which extends in a direction forming an acute second angle with the centre axis, and wherein the first angle is significantly larger than the second angle. The pattern of the transition area may according to this embodiment be designed as a herringbone pattern with a relatively low flow resistance, i.e. a so-called pattern with low NTU.

According to a further embodiment of the invention, at least some of the second contact surfaces are provided along at least one line extending in parallel with the borderline and located at a distance from the borderline, which distance is relatively small and significantly shorter than the second distance. In such a way, the support points between adjacent heat exchanger plates will be positioned close to the distribution area and contribute to an improved strength in this part of the heat exchanger plate.

According to a further embodiment of the invention, said direction extends substantially perpendicularly to the centre axis.

According to a further embodiment of the invention, the projections and depressions of the transition area are designed in such a way that the second contact surfaces obtain an approximate point-shape when the heat exchanger plate is provided in the plate package adjacent to another heat exchanger plate.

According to a further embodiment of the invention, the projections and depressions of the distribution area are adapted to abut depressions and projections, respectively, of adjacent heat exchanger plates in the plate package for forming third contact surfaces. Furthermore, the projections and depressions of the distribution area may be designed in such a way that the third contact surfaces obtain an approximate line-shape when the heat exchanger plate is provided in the plate package adjacent to another heat exchanger plate. Such a design includes a so called distribution pattern.

The object is also achieved by the initially defined pair of heat exchanger plates, which is characterized in that the central heat transfer area of at the least the first heat exchanger plate comprises at least a first transition area, which adjoins the first distribution area along the borderline and which in relation to the extension plane has projections and depressions which are adapted to abut depressions and projections, respectively, of a central heat transfer area of the second heat exchanger plate for forming second contact surfaces which are positioned at a second distance from each other along said first direction which is substantially parallel with the borderline, wherein the second distance is significantly shorter than the first distance.

Furthermore the object is achieved by the initially defined plate package which is characterized in that the central heat transfer area of at least the first heat exchanger plates comprises at least a first transition area, which adjoins the first distribution area along the borderline and which in relation to the extension plane has projections and depressions which are adapted to abut depressions and projections, respectively, of a central heat transfer area of the second heat exchanger plates for forming second contact surfaces which are positioned at a second distance from each other along said first direction which is substantially parallel with the borderline, wherein the second distance is significantly shorter than the first distance.

BRIEF DESCRIPTION OF THE DRAWINGS

The present invention is now to be explained more closely through a description of various embodiments and with reference to the drawings attached hereto.

DETAILED DESCRIPTION OF VARIOUS EMBODIMENTS OF THE INVENTION

Figure 1:
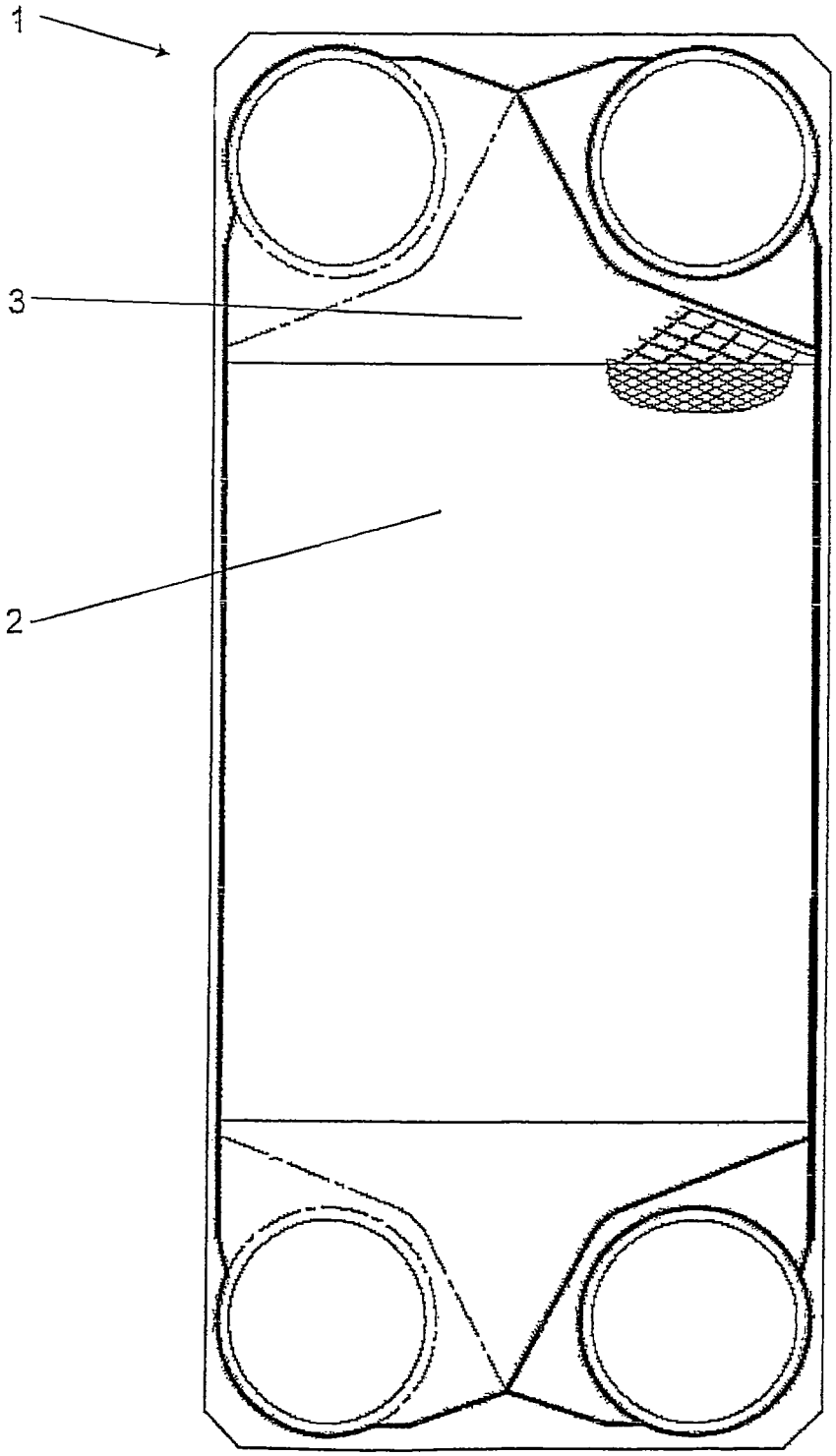
FIG. 1 discloses schematically a plan view of a heat exchanger plate according to the prior art.
Figure 2:
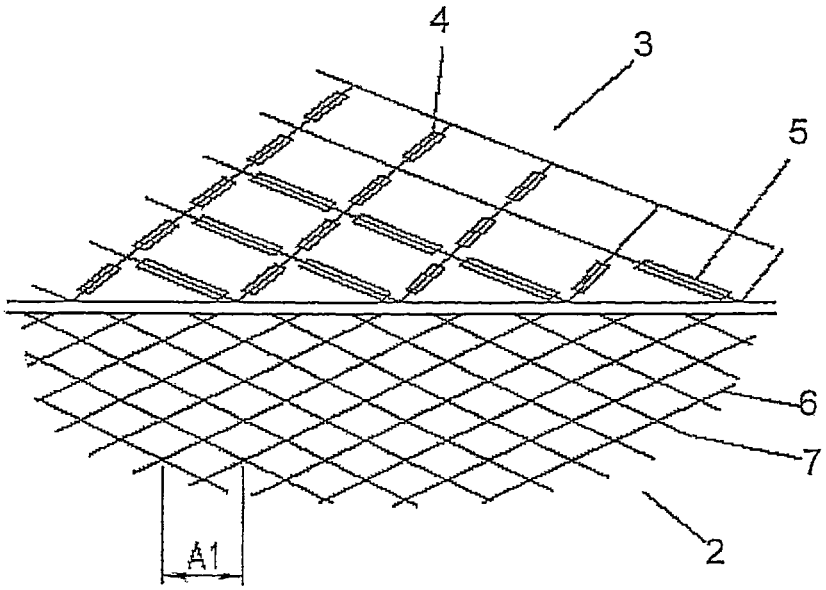
FIG. 2 discloses more closely an area at the top to the right of the heat exchanger plate in FIG. 1.
Figure 3:
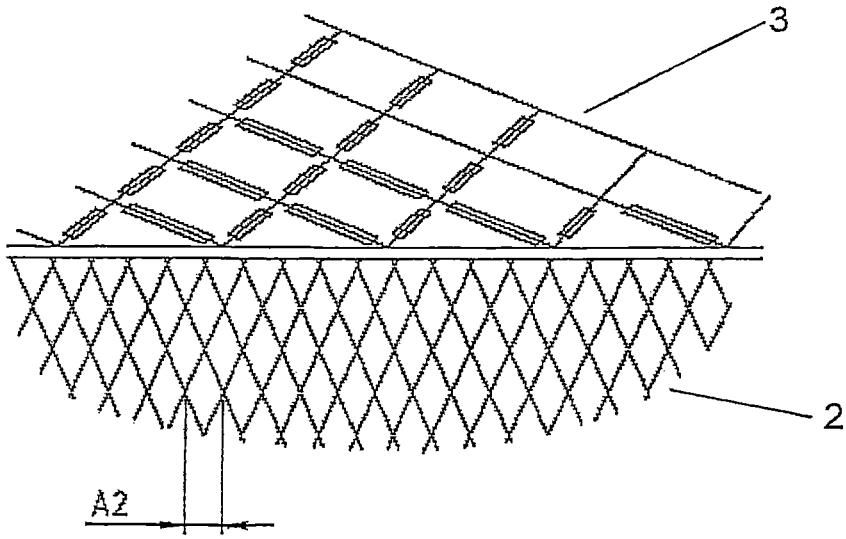
FIG. 3 discloses the area in FIG. 2 with an alternative pattern.
Figure 4:
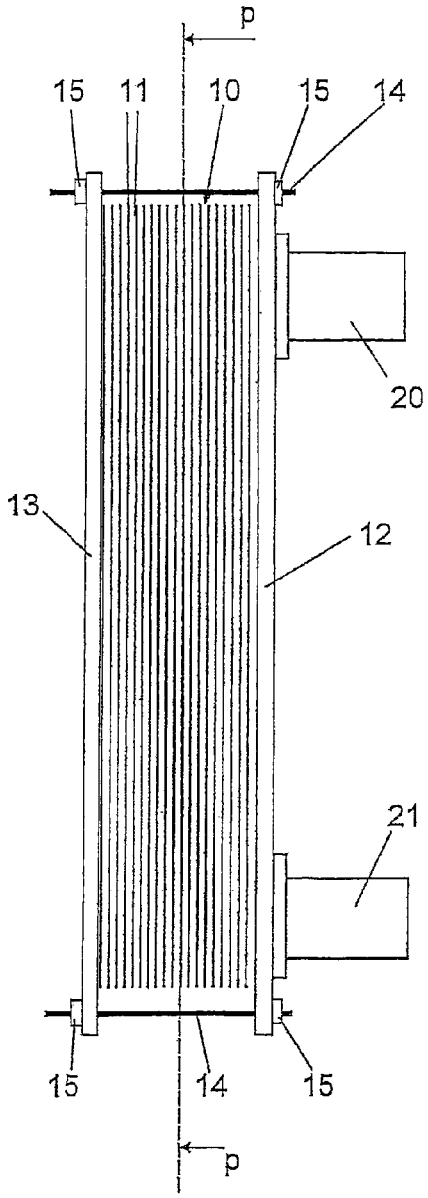
FIG. 4 discloses schematically a side view of a plate heat exchanger with a plate package of heat exchanger plates.
Figure 5:
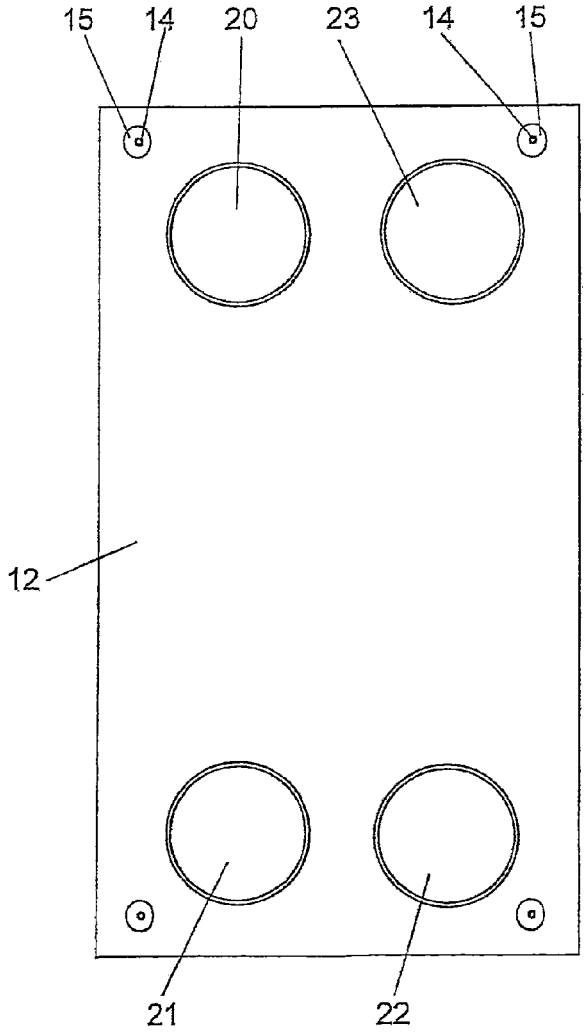
FIG. 5 discloses schematically a front view of the plate heat exchanger in FIG. 4.

FIGS. 4 and 5 disclose a plate heat exchanger according to the invention for receiving a first medium and a second medium. The plate heat exchanger comprises a plate package 10 with a number of heat exchanger plates 11 which are provided adjacent to each other. The plate package 10 is provided between a frame plate 12 and a pressure plate 13. The pressure plate 13 is pressed against the plate package 10 and the frame plate 12 by means of tie bolts 14 which extend through the plates 12 and 13. The tie bolts comprise threads and the plate package may thus be compressed by threading a nut 15 on the tie bolts 14 in a manner known per se. In the embodiment disclosed, four tie bolts 14 are indicated. It is to be noted that a number of tie bolts 14 can vary and be different in various applications. It is also to be noted that even if the following description refers to plate heat exchangers provided with gaskets and compressed by means of tie bolts or the like, the invention is also applicable to plate heat exchangers having permanently joined heat exchanger plates, for instance brazed plate heat exchangers. The invention may also be applied to plate heat exchangers having pairs of permanently joined heat exchanger plates, where two heat exchanger plates for instance may be welded to each other.

The plate heat exchanger comprises a first inlet 20 for the first medium, a first outlet 21 for the first medium, a second inlet 22 for the second medium and a second outlet 23 for the second medium. The inlets and outlets 20-23 extend through the frame plate 12 and the plate package 10.

Figure 6:
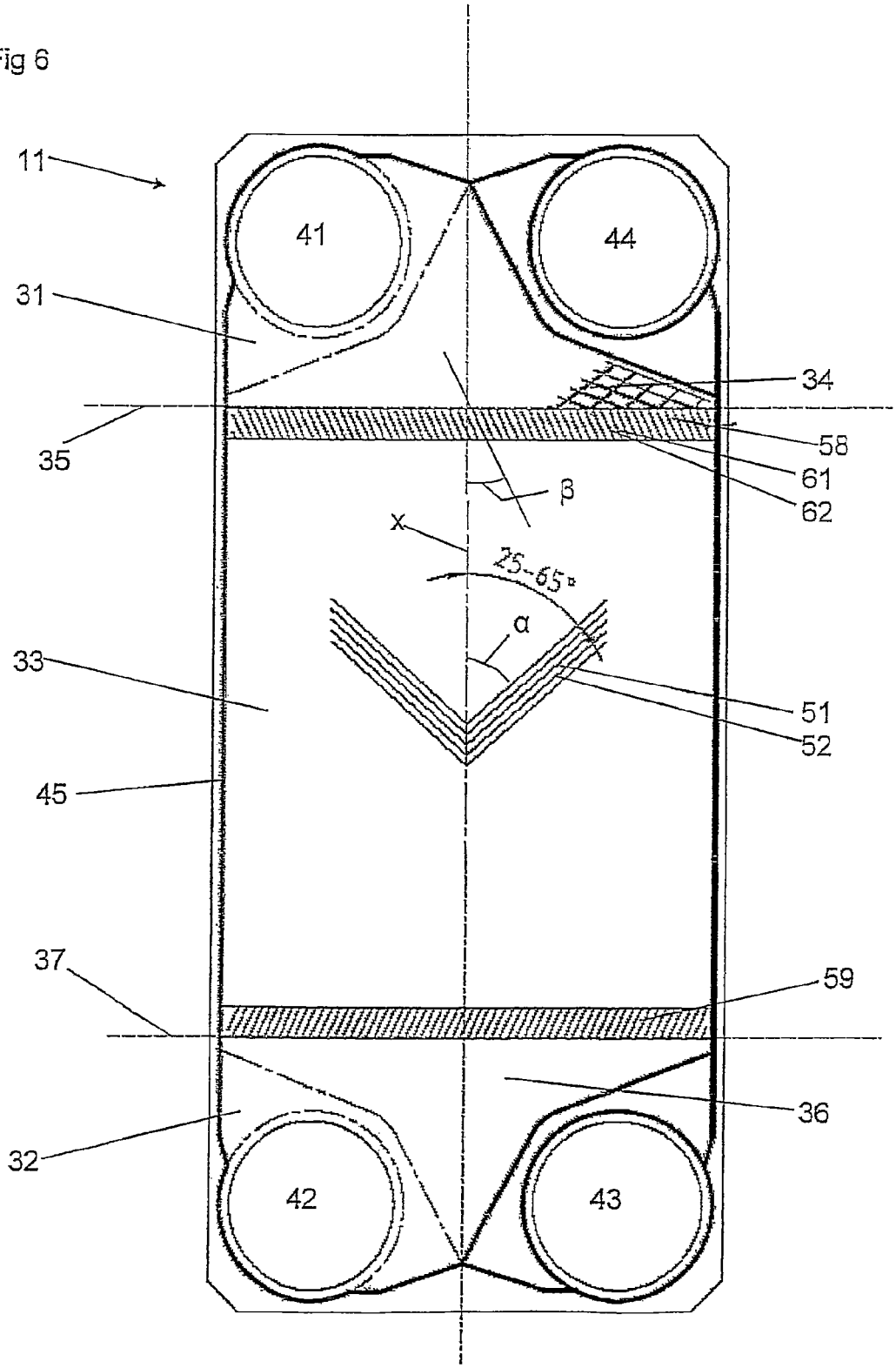
FIG. 6 discloses schematically a plan view of a heat exchanger plate for the plate package and the plate heat exchanger in FIGS. 4 and 5.

FIG. 6 discloses a heat exchanger plate 11 for the plate heat exchanger in FIGS. 4 and 5. The heat exchanger plate 11 is compression-moulded and extends along a central extension plane p-p, see FIG. 4. The heat exchanger plate 11 comprises a first end area 31, a second end area 32 and a central heat transfer area 33, which extends between and adjoins the first end area 31 and the second end area 32. A centre axis x extends along the heat exchanger plate 11 in the central extension plane p-p through the first end area 31, the central heat transfer area 33 and the second end area 32.

A first distribution area 34 extends on the first end area 31 and adjoins the central heat transfer area 33 along a first borderline 35. A second distribution area 36 extends on the second end area 32 and adjoins the central heat transfer area 33 along a second borderline 37. In the embodiments disclosed, the borderlines 35 and 37 are substantially perpendicular to the centre axis x. It is to be noted, however, that the borderlines 35 and 37 may have a certain inclination in relation to the centre axis x, may be curved or extend in different directions along different portions of the borderlines 35, 37.

Each heat exchanger plate 11 also comprises four portholes 41, 42, 43 and 44 for the inlets and outlets 20-23. The portholes 41 and 44 are provided on the first end area 31 and the portholes 42 and 43 on the second end area 32. Between each pair of heat exchanger plates 11, a first gasket 45 is provided for defining a first plate interspace for the first medium between two adjacent heat exchanger plates and a second plate interspace for the second medium between two adjacent heat exchanger plates 11. The first plate interspaces communicate with the first inlet 20 and the first outlet 21 via two of the portholes 41-44. The second plate interspaces communicate with the second inlet 22 and the second outlet 23 via two of the portholes 41-44.

Figure 7:
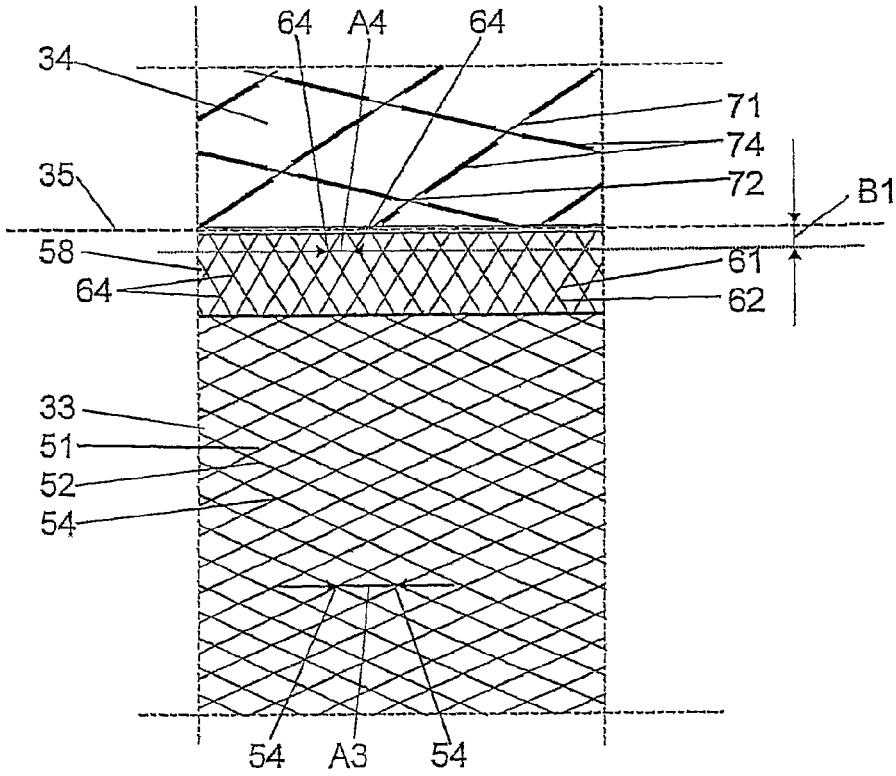
FIG. 7 discloses schematically an area of two adjacent heat exchanger plates according to a first embodiment.
Figure 8:
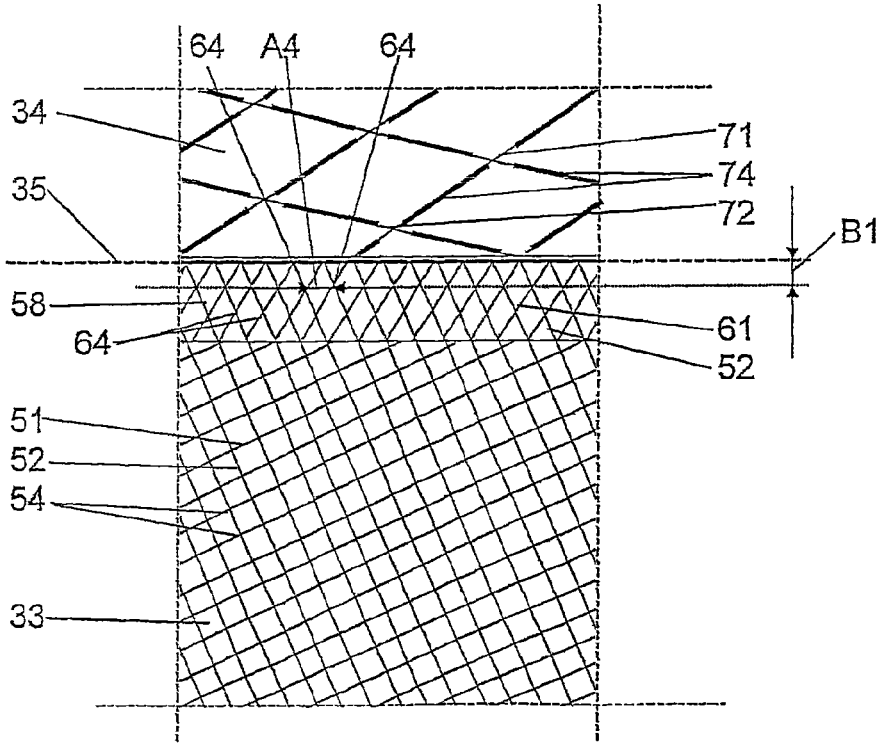
FIG. 8 discloses schematically an area of two adjacent heat exchanger plates according to a second embodiment.

The central heat transfer area 33 has in relation to the central extension plane p-p a pattern or a corrugation of projections 51 and depressions 52, which form parallel ridges and valleys and are adapted to abut depressions 52 and projections 51, respectively, on a central heat transfer area 33 of adjacent heat exchanger plates 11 in the plate package 10 in such a way that first contact surfaces 54 are formed between the projections 51 and depressions 52. In FIGS. 7 and 8 this is illustrated by the projections 51 of one heat exchanger plate 11 which abut and cross the depressions 52 of an adjacent heat exchanger plate 11.

In the embodiments disclosed, the corrugation of parallel projections 51 and depressions 52 of the central heat transfer area 33 extend in a direction forming an acute first angle α with the centre axis x, see FIG. 6. With such a corrugation of parallel ridges and valleys, the first contact surfaces 54 will obtain an approximate point shape when one of the two adjacent heat exchanger plates 11 is turned 180° in the central extension plane p-p, see FIGS. 7 and 8. The pattern of projections 51 and depressions 52 of the central heat transfer area 33 is in the embodiments disclosed designed as a so-called herringbone pattern. The first contact surfaces 54 are positioned at a first distance A3 from each other along a direction, which in the embodiment disclosed in FIG. 7 is substantially parallel with the borderline 35 and thus substantially perpendicular to the centre axis x. In the embodiment disclosed in FIG. 8, a corresponding direction forms an acute angle with the borderline 35.

The central heat transfer area 33 also comprises a first transition area 58 which adjoins the first distribution area 31 along the borderline 35, and a second transition area 59, which adjoins the second distribution area 32 along the borderline 37. Each of the first and second transition areas 58, 59 has in relation to the central extension plane p-p a pattern or a corrugation of projections 61 and depressions 62. These projections 61 and depressions 62 are adapted to abut depressions and projections, respectively, of a central heat transfer area 33 of an adjacent heat exchanger plate 11 in such a way that second contact surfaces 64 are formed. The depressions and projections of the central heat transfer area 33 of the adjacent heat exchanger plate 11 may then be formed by either the depressions 62 and projections 61 of a transition area 58, 59 of the central heat transfer area 33 of the adjacent heat exchanger plate 11, see FIG. 7, or of the depressions 52 and projections 51 of the central heat transfer area 33, see FIG. 8.

The first distribution area 34 and the second distribution area 36 both have in relation to the extension plane p-p also a pattern or a corrugation of projections 71 and depressions 72, which are adapted to abut depressions 72 and projections 71, respectively, of a distribution area 34, 36 of adjacent heat exchanger plates 11 in the plate package 10 for providing a uniform distribution of the respective medium conveyed from one of the port holes 41, 43 to the central heat transfer area 33 or for conveying in a favourable manner the respective medium from the central heat transfer area 33 to one of the port holes 42, 44. The distribution areas 34, 36 are designed in such a way that the pattern of projections 71 and depressions 72 gives a relatively small flow resistance, especially in relation to the flow resistance of a central heat transfer area 33 with a pattern with high NTU.

The projections 71 and depressions 72 of the distribution area 33 are adapted to abut depressions 72 and projections 71, respectively, of adjacent heat exchanger plates 11 in such a way that third contact surfaces 74 are formed between the projections 71 and the depressions 72, which surfaces obtain an approximate line shape when a heat exchanger plate 11 is provided adjacent to another heat exchanger plate 11 which is rotated 180° in the extension plane p-p. A pattern of projections 71 and depressions 72 of the distribution areas 34, 36 is in the embodiments disclosed designed as a so-called distribution pattern.

The first transition area 58 and the second transition area 59 have a respective pattern or a respective corrugation, which forms said projections 61 and depressions 62 and which extends in a direction forming an acute second angle β with the centre axis x, see FIG. 6. The second angle β is relatively small and may suitably be in the order of 20-35°, for instance 25°.

In the embodiment disclosed in FIG. 7, the first angle α is relatively large, for instance in the order of 65°, i.e. substantially larger than the second angle β. Thus a so-called pattern with high NTU is obtained i.e. a central heat transfer area 33 with a relatively high heat transfer and a relatively high flow resistance and pressure drop. With such a large first angle α, a relatively large distance A3 between the contact surfaces 54 is achieved, and the initially defined problems with the strength at the transition between the distribution area 34, 36 and the central heat transfer area 33. This problem can be overcome with the transition area 58, 59 disclosed. The second contact surfaces 64 of the transition area 58, 59 are positioned at a second distance A4 between each other along a direction which is substantially parallel to the borderline 35, 37. The second distances A4 are significantly shorter than the first distances A3. Thus the number of support points between adjacent heat exchanger plates 11 is increased in the transition area 58, 59 and hence the strength is improved.

Furthermore, some of the second point-shaped contact surfaces 64 are provided along at least one line which extends in parallel with the borderline 35, 37 and is located at a distance B1 from the borderline 35, 37, which distance is relatively small. Especially, the distance B1 is significantly shorter than the second distance A4.

In the embodiment disclosed in FIG. 8, two types of heat exchanger plates are used, wherein one is provided with a transition area 58 which has another pattern design than the central heat transfer area 33 whereas the other heat exchanger plate 11 has substantially the same pattern design on the transition area and the central heat transfer area 33. More precisely, one of the heat exchanger plates 11 is designed in substantially the same manner as the heat exchanger plates according to the first embodiment disclosed in FIG. 7 whereas the other heat exchanger plate 11 has substantially the same design as the heat exchanger plates according to the prior art. The second heat exchanger plate 11, however, has a so-called pattern with a low NTU, i.e. the first angle α is relatively small and is equal to or substantially equal to the second angle β of the transition area 58 of the first heat exchanger plate 11.

The present invention is not limited to the embodiments disclosed but may be varied and modified within the scope of the following claims.

The invention claimed is:

1. A heat exchanger plate for a plate package for a plate heat exchanger for receiving a first medium and a second medium, wherein the heat exchanger plate has a central extension plane and comprises a first end area, a second end area, a central area, which extends between the first end area and the second end area, wherein a center axis extends along the heat exchanger plate through the first end area, the central area and the second end area, a first distribution area which extends on the first end area and adjoins the central area along a first borderline, wherein the first distribution area in relation to the extension plane has projections and depressions which are adapted to abut depressions and projections, respectively, on a distribution area of adjacent heat exchanger plates in the plate package for providing a uniform distribution of said media along the first borderline, a second distribution area which extends on the second end area and adjoins the central area along a second borderline, wherein the second distribution area in relation to the extension plane has projections and depressions which are adapted to abut depressions and projections respectively on a distribution area of adjacent heat exchanger plates in the plate package for providing a uniform distribution of the media along the second borderline, wherein the central area comprises a heat transfer area having, in relation to the extension plane, projections and depressions which are adapted to abut depressions and projections, respectively, on a heat transfer area of adjacent heat exchanger plates in the plate package for forming first contact surfaces which are positioned at a first distance from each other along a first direction which is substantially parallel with the first borderline, wherein the central area further comprises a first transition area and a second transition area both adjoining the heat transfer area, the first and second transition areas together being essentially smaller than the heat transfer area, the first transition area, adjoining the first distribution area along the first borderline, and the second transition area adjoining the second distribution area along the second borderline, wherein the first transition area and the second transition area in relation to the extension plane have projections and depressions which are adapted to abut depressions and projections, respectively, of a central area of adjacent heat exchanger plates in the plate package for forming second contact surfaces which are positioned at a second distance from each other along said first direction which is substantially parallel with the first borderline, wherein the second distance is significantly shorter than the first distance, and wherein the heat transfer area has a corrugation, which forms said projections and depressions and which extends along an inclination direction forming an acute first angle with the center axis, wherein the first transition area and the second transition area have a corrugation, which forms said projections and depressions and which extends along an inclination direction forming an acute second angle with the center axis, and wherein the first angle is larger than the second angle.

2. A heat exchanger plate according to claim 1, wherein at least some of the second contact surfaces are provided along at least one line extending in parallel with the borderline and located at a distance from the borderline, which distance is relatively small and significantly shorter than the second distance.

3. A heat exchanger plate according to claim 1, wherein said first direction extends substantially perpendicularly to the center axis.

4. A heat exchanger plate according to claim 1, wherein the projections and the depressions of the first and second transition areas are designed in such a way that the second contact surfaces obtain an approximate point shape when the heat exchanger plate is provided in the plate package adjacent to another heat exchanger plate.

5. A heat exchanger plate according to claim 1, wherein the projections and the depressions of the first and second distribution areas are adapted to abut depressions and projections, respectively, of adjacent heat exchanger plates in the plate package for forming third contact surfaces.

6. A heat exchanger plate according to claim 5, wherein the projections and depressions of the first and second distribution areas are designed in such a way that the third contact surfaces obtain an approximate line shape when the heat exchange plate is provided in the plate package adjacent to another heat exchanger plate.

7. A pair of heat exchanger plates comprising a first heat exchanger plate and a second heat exchanger plate, which are adapted to abut each other in a plate package for a plate heat exchanger for receiving a first medium and a second medium, wherein each of the heat exchanger plates has a central extension plane and comprises a first end area, a second end area, a central area, which extends between the first end area and the second end area, wherein a center axis extends along the heat exchanger plate through the first end area, the central area and the second end area, a first distribution area which extends on the first end area and adjoins the central area along a first borderline, wherein the first distribution area in relation to the extension plane has projections and depressions which are adapted to abut depressions and projections, respectively, on a distribution area of adjacent heat exchanger plates in the plate package for providing a uniform distribution of said media along the first borderline, a second distribution area which extends on the second end area and adjoins the central area along a second borderline, wherein the second distribution area in relation to the extension plane has projections and depressions which are adapted to abut depressions and projections respectively on a distribution area of adjacent heat exchanger plates in the plate package for providing a uniform distribution of the media along the second borderline, wherein the central area comprises a heat transfer area having, in relation to the extension plane, projections and depressions which are adapted to abut depressions and projections, respectively, on a heat transfer area of adjacent heat exchanger plates in the plate package for forming first contact surfaces which are positioned at a first distance from each other along a first direction which is substantially parallel with the first borderline, and wherein the central area of the first heat exchanger plate further comprises a first transition area and a second transition area both adjoining the heat transfer area, the first and second transition areas together being essentially smaller than the heat transfer area, the first transition area, adjoining the first distribution area along the first borderline, and the second transition area adjoining the second distribution area along the second borderline, wherein the first transition area and the second transition area in relation to the extension plate have projections and depressions which are adapted to abut depressions and projections respectively, of a central area of the second heat exchanger plate for forming second contact surfaces which are positioned at a second distance from each other along said first direction which is substantially parallel with the first borderline, wherein the second distance is significantly shorter than the first distance, and wherein the heat transfer area of the first heat exchanger plate has a corrugation, which forms said projections and depressions and which extends along an inclination direction forming an acute first angle with the center axis, wherein the first transition area and the second transition area have a corrugation, which forms said projections and depressions and which extends along an inclination direction forming an acute second angle with the center axis, and wherein the first angle is larger than the second angle.

8. A pair of heat exchanger plates according to claim 7, wherein the central area of the second heat exchanger plate comprises at least a first transition area, which adjoins the first distribution area along the first borderline and which in relation to the extension plane has projections and depressions which are adapted to abut depressions and projections, respectively, of the first transition area of the first heat exchanger plate for forming said second contact surfaces which are positioned at a second distance from each other along said first direction which is substantially parallel with the first borderline, wherein the second distance is significantly shorter than the first distance.

9. A pair of heat exchanger plates according to claim 7, wherein at least some of the second contact surfaces are provided along at least a line which extends in parallel with the first borderline and is located at a distance from the first borderline, which distance is relatively small and significantly shorter than the second distance.

10. A pair of heat exchanger plates according to claim 7, wherein said first direction extends substantially perpendicularly to the center axis.

11. A pair of heat exchanger plates according to claim 7, wherein the projections and depressions of the first transition area are designed in such a way that the second contact surfaces obtain an approximate point shape.

12. A pair of heat exchanger plates according to claim 7, wherein the projections and depressions of the first and second distribution areas of the first heat exchanger plate abut depressions and projections, respectively, of the adjacent second heat exchanger plate for forming third contact surfaces.

13. A pair of heat exchanger plates according to claim 12, wherein the projections and depressions of the first and second distribution areas are designed in such a way that the third contact surfaces obtain an approximate line shape.

14. A pair of heat exchanger plates according to claim 7, wherein the second heat exchanger plate is turned 180° in relation to the first heat exchanger plate in the extension plane.

15. A plate package for a plate heat exchanger for receiving a first medium and a second medium, which plate package comprises first heat exchanger plates and second heat exchanger plates which are provided adjacent to each other in an alternating order in the plate package, wherein each of the heat exchanger plates has a central extension plane and comprises a first end area, a second end area, a central area, which extends between the first end area and the second end area, wherein a center axis extends along the heat exchanger plate through the first end area, the central area and the second end area, a first distribution area which extends on the first end area and adjoins the central heat transfer area along a first borderline, wherein the first distribution area in relation to the extension plane has projections and depressions which are adapted to abut depressions and projections, respectively, on a distribution area of adjacent heat exchanger plates in the plate package for providing a uniform distribution of said media along the first borderline, a second distribution area which extends on the second end area and adjoins the central area along a second borderline, wherein the second distribution area in relation to the extension plane has projections and depressions which are adapted to abut depressions and projections respectively on a distribution area of adjacent heat exchanger plates in the plate package for providing a uniform distribution of the media along the second borderline, wherein the central area comprises a heat transfer area having, in relation to the extension plane, projections and depressions which are adapted to abut depressions and projections, respectively, on a heat transfer area of adjacent heat exchanger plates in the plate package for forming first contact surfaces which are positioned at a first distance from each other along a first direction which is substantially parallel with the first borderline, and wherein the central area of the first heat exchanger plates further comprises a first transition area and a second transition area both adjoining the heat transfer area, the first and second transition areas together being essentially smaller than the heat transfer area, the first transition area, adjoining the first distribution area along the first borderline, and the second transition area, adjoining the second distribution area along the second borderline, wherein the first transition area and the second transition area in relation to the extension plane have projections and depressions which are adapted to abut depressions and projections, respectively, of a central area of adjacent heat exchanger plates for forming second contact surfaces which are positioned at a second distance from each other along said first direction which is substantially parallel with the first borderline, wherein the second distance is significantly shorter than the first distance, and wherein the heat transfer area of the first heat exchanger plates has a corrugation, which forms said projections and depressions and which extends along an inclination direction forming an acute first angle with the center axis, wherein the first transition area and the second transition area have a corrugation, which forms said projections and depressions and which extends along an inclination direction forming an acute second angle with the center axis, and wherein the first angle is larger than the second angle.

16. A plate package according to claim 15, wherein the central area of the second heat exchanger plates comprises at least a first transition area, which adjoins the first distribution area along the first borderline and which in relation to the extension plane has projections and depressions which are adapted to abut depressions and projections, respectively, of the first transition area of the first heat exchanger plates for forming said second contact surfaces which are positioned at the second distance from each other along said direction which is substantially parallel with the first borderline, wherein the second distance is significantly shorter than the first distance.

17. A plate package according to claim 15, wherein at least some of the second contact surfaces are provided along at least a line which extends in parallel with the first borderline and is located at a distance from the first borderline, which distance is relatively small and significantly shorter than the second distance.

18. A plate package according to claim 15, wherein said first direction extends substantially perpendicularly to the center axis.

19. A plate package according to claim 15, wherein the projections and depressions of the first and the second transition areas are designed in such a way that the second contact surfaces obtain an approximate point shape.

20. A plate package according to claim 15, wherein the projections and depressions of the first and second distribution areas of the first heat exchanger plates abut depressions and projections, respectively, of the adjacent second heat exchanger plates of the plate package for forming third contact surfaces.

21. A plate package according to claim 20, wherein the projections and depressions of the first and second distribution areas are designed in such a way that the third contact surfaces obtain an approximate line shape.

22. A plate package according to claim 15, wherein the second heat exchanger plates are turned 180° in relation to the first heat exchanger plates in the extension plane.

* * * * *